US007121088B2

(12) United States Patent
Lavin

(10) Patent No.: US 7,121,088 B2
(45) Date of Patent: Oct. 17, 2006

(54) AUTOMOTIVE EXHAUST VALVE

(75) Inventor: David John Lavin, Shelby Township, Macomb County, MI (US)

(73) Assignee: General Motors Corporation, Detroit, MI (US)

( * ) Notice: Subject to any disclaimer, the term of this patent is extended or adjusted under 35 U.S.C. 154(b) by 58 days.

(21) Appl. No.: 10/852,601

(22) Filed: May 24, 2004

(65) Prior Publication Data

US 2005/0257517 A1 Nov. 24, 2005

(51) Int. Cl.
*F01N 7/10* (2006.01)

(52) U.S. Cl. ..... 60/324; 60/287; 60/291; 60/292; 60/313; 137/595; 137/607; 137/862

(58) Field of Classification Search ..... 60/291, 60/292, 293, 287, 312, 313, 322, 323, 324, 60/288; 137/595, 601, 607, 862
See application file for complete search history.

(56) References Cited

U.S. PATENT DOCUMENTS 3,908,366 A * 9/1975 Masaki ..... 60/277
3,992,879 A * 11/1976 Miyamori et al. ..... 60/288
4,875,336 A * 10/1989 Hayashi et al. ..... 60/286
4,939,898 A * 7/1990 Ichimura et al. ..... 60/274
5,427,141 A * 6/1995 Ohtsubo ..... 137/595
6,584,767 B1 * 7/2003 Koenig ..... 60/288
6,609,367 B1 * 8/2003 Nakayasu et al. ..... 60/324

* cited by examiner

*Primary Examiner*—Binh Q. Tran
(74) *Attorney, Agent, or Firm*—Laura C. Hargitt

(57) ABSTRACT

A valve assembly is adapted to be disposed in an automotive engine exhaust system at an outlet of an internal combustion engine. The assembly includes a valve body having an opening therethrough including an inlet portion and an outlet portion. A first valve and a second valve are disposed in the opening intermediate the inlet and outlet portions. The first and second valves have an open position and a closed position. The first valve blocks a first predetermined amount of the opening when in the closed position. The second valve blocks a second predetermined amount of the opening when in the closed position, with the second predetermined amount being less than the first predetermined amount. An actuator is connected to the first valve and the second valve and is operable to selectively move each of the valves between respective the open positions and the closed positions.

18 Claims, 4 Drawing Sheets

AUTOMOTIVE EXHAUST VALVE

BACKGROUND OF THE INVENTION

The present invention relates generally to automotive exhaust systems and, in particular, to a valve in an automotive exhaust system.

Automotive exhaust systems function to rout and treat an exhaust gas stream from an inlet connected to an internal combustion engine to an outlet to atmosphere. Exhaust systems include piping attached to the engine, and mufflers, catalytic converters, resonators and the like disposed in the piping to remove impurities and noises from the exhaust gas stream prior to the exhaust stream exiting to atmosphere. Exhaust systems function to maintain the flow of exhaust gases to atmosphere while also providing back pressure, i.e. restriction, for the engine.

With some newer engines able to switch between an eight cylinder mode and a four cylinder mode, this new powertrain option results in a high exhaust gas output mode and a low exhaust gas output mode. By varying the displacement of the engine, drastically different exhaust flow rates are produced, for example, when the engine is in eight cylinder or high output mode compared to when, for example, the engine is in a four cylinder or low output mode. Current commercially available valves in the exhaust system have dual inlet chambers containing flapper valves, which valves are passive devices that perform an open/closed operation to direct flow to a single outlet chamber. However, these passive devices are incapable of providing an adjustable restriction to exhaust gas flow due to changes in exhaust gas flow from a variable displacement engine.

It is desirable, therefore, to provide an exhaust valve assembly that is adapted to be disposed in an automotive exhaust system and is operable to maintain both flow and back pressure requirements for the exhaust system regardless of the type of engine and especially for an engine whose exhaust flows and back pressures can vary greatly due to engine cylinder deactivation.

SUMMARY OF THE INVENTION

The present invention concerns a valve assembly adapted to be disposed in an automotive engine exhaust system at an outlet of an internal combustion engine. The assembly includes a valve body having an opening therethrough including an inlet portion and an outlet portion. A first valve and a second valve are disposed in the opening intermediate the inlet and outlet portions. The first and second valves have an open position and a closed position. The first valve blocks a first predetermined amount of the opening when in the closed position. The second valve blocks a second predetermined amount of the opening when in the closed position, with the second predetermined amount being less than the first predetermined amount. An actuator is connected to the first valve and the second valve and is operable to selectively move each of the valves between respective the open positions and the closed positions.

The valve assembly in accordance with the present invention controls two exhaust flow rates with the use of two different sized restrictor plates or valves. Preferably, the valves are attached to and adjusted by a valve shaft that is actuated by an actuator in communication with a controller. The automotive engine may be a variable displacement internal combustion engine having cylinder deactivation features that produces drastically different flow rates in a first mode of high exhaust gas output, such as an eight cylinder operating mode and a second mode of low exhaust gas output, such as a four cylinder operating mode. The valve assembly in accordance with the present invention advantageously controls two exhaust gas flow rates where the exhaust system requires a predetermined range of exhaust gas flow rate and exhaust gas back pressure with a dual inlet portion and a dual outlet portion.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
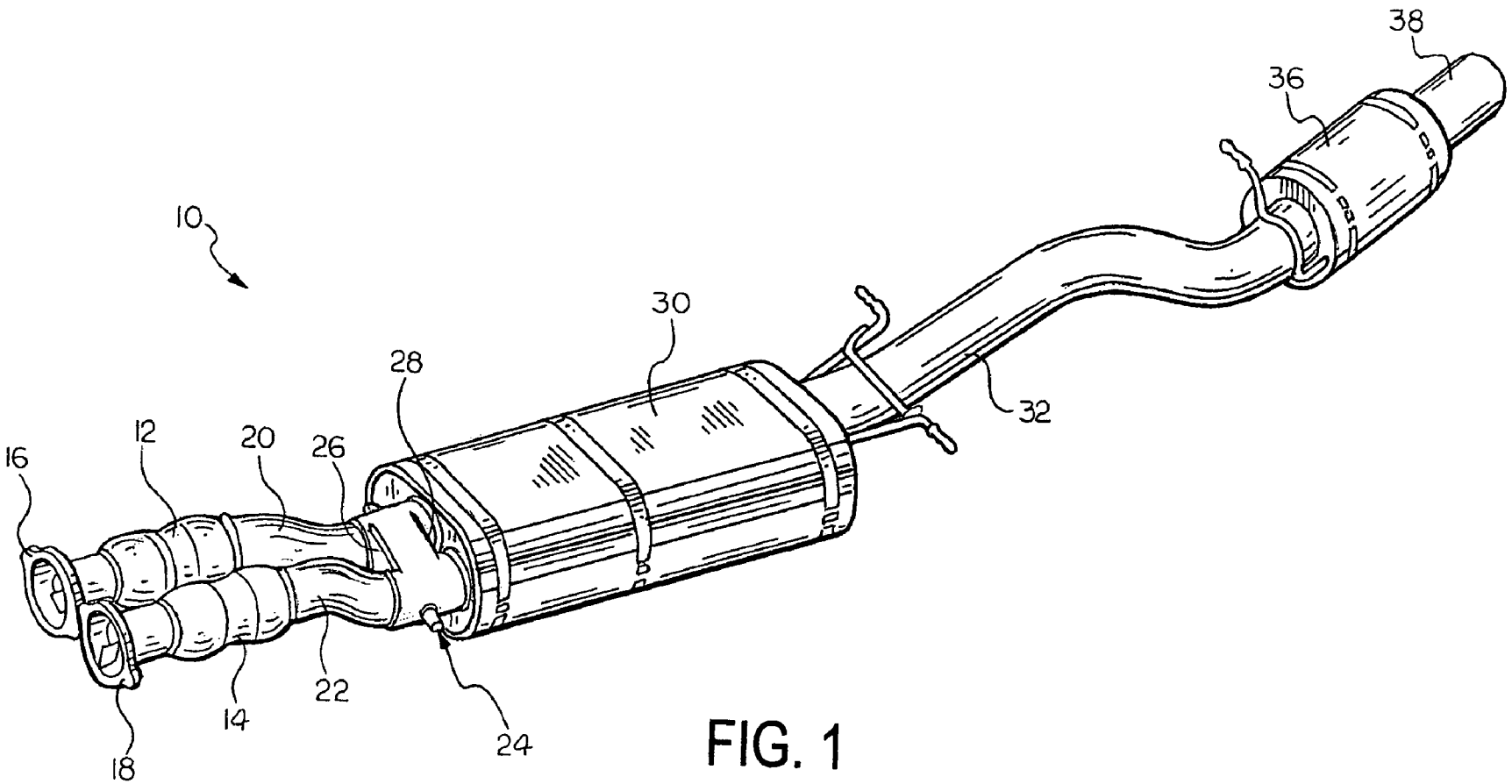
FIG. 1 is a schematic perspective view of an exhaust system with a valve assembly in accordance with the present invention.

Referring now to FIG. 1, an exhaust system in accordance with the present invention is indicated generally at 10. The exhaust system 10 includes a first exhaust pipe 12 and a second exhaust pipe 14. An end 16 of the first exhaust pipe 12 and an end 18 of the second exhaust pipe 14 are each adapted to be attached to an outlet of an internal combustion engine (not shown), preferably via an exhaust manifolds (not shown), catalytic converters (not shown), or other conventional exhaust system components. An end 20 of the first exhaust pipe 12 opposite the end 16 and an end 22 of the second exhaust pipe 14 opposite the end 18 are each adapted to be attached to an inlet portion 26 of an exhaust valve assembly, indicated generally at 24. An outlet 28 of the exhaust valve assembly 24 is adapted to be attached to an inlet of a muffler 30. An outlet of the muffler 30 is attached to an exhaust pipe 32, which is attached to an inlet of a resonator 36. An outlet of the resonator 36 is attached to another exhaust pipe 38, which extends to a tail pipe (not shown) that is open to the atmosphere.

Figure 2:
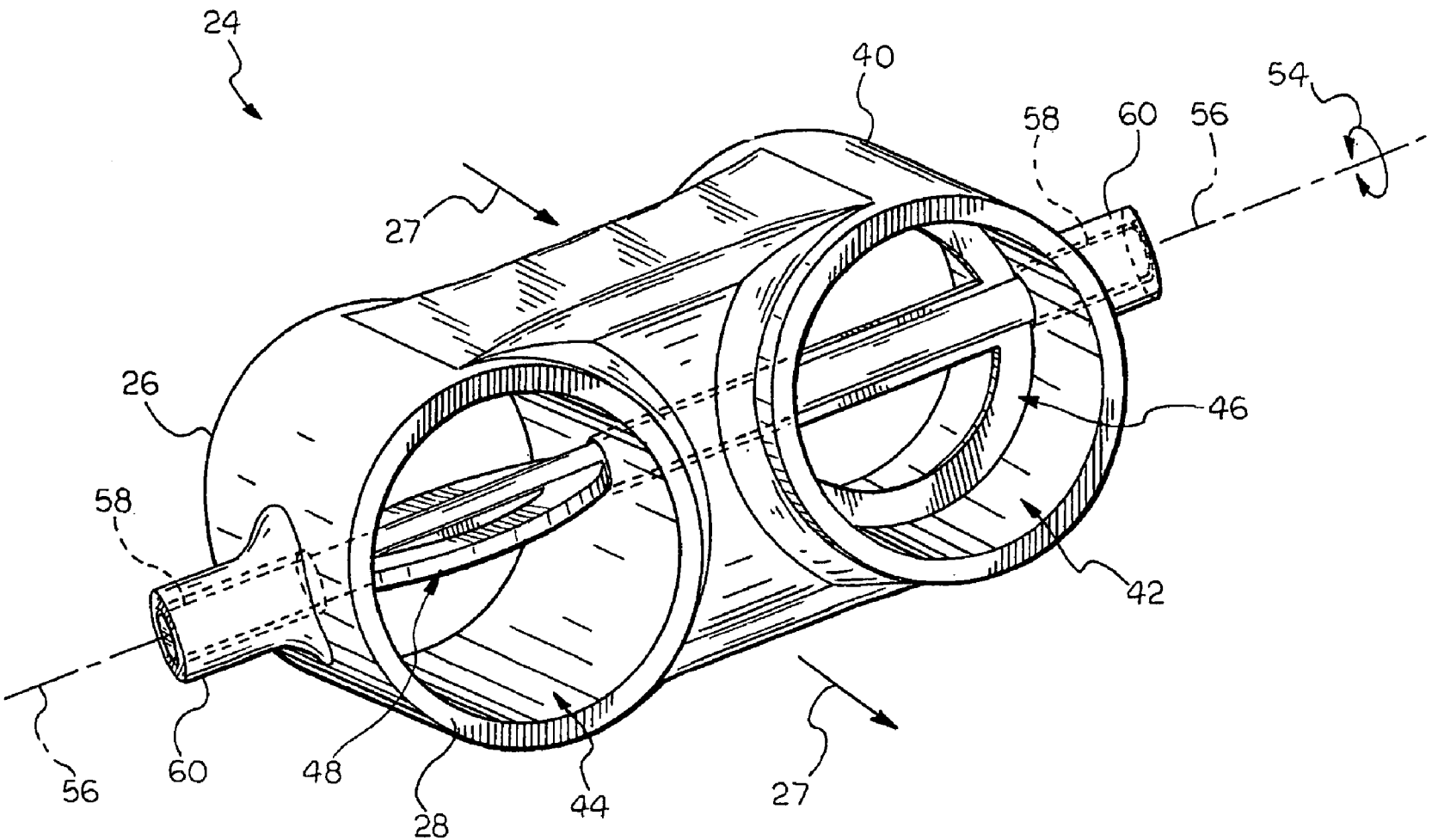
FIG. 2 is a perspective view of the valve assembly of FIG. 1 shown with the valves in a first position.
Figure 3:
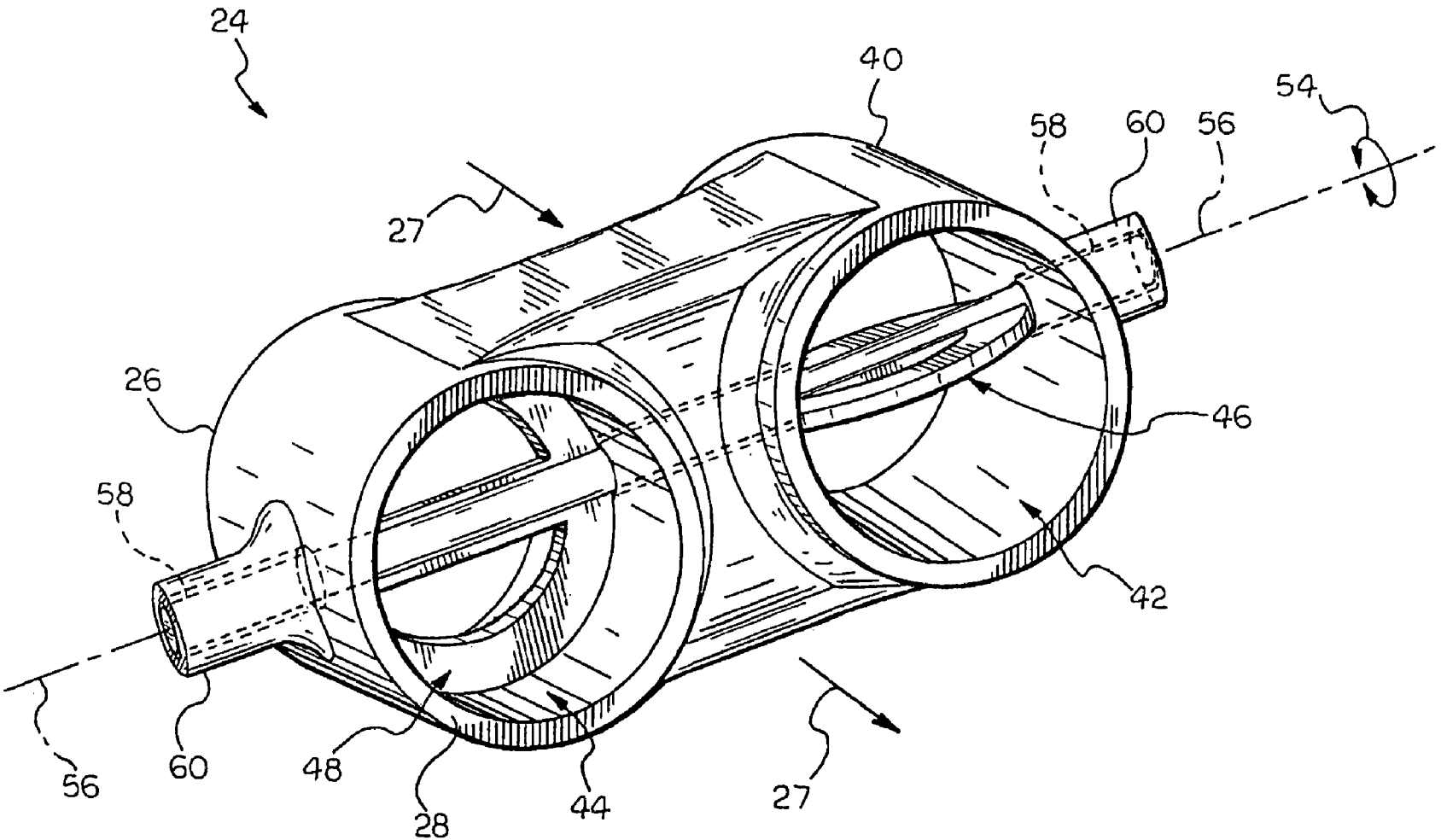
FIG. 3 is a perspective view of the valve assembly of FIG. 1 shown with the valves in a second position.
Figure 4:
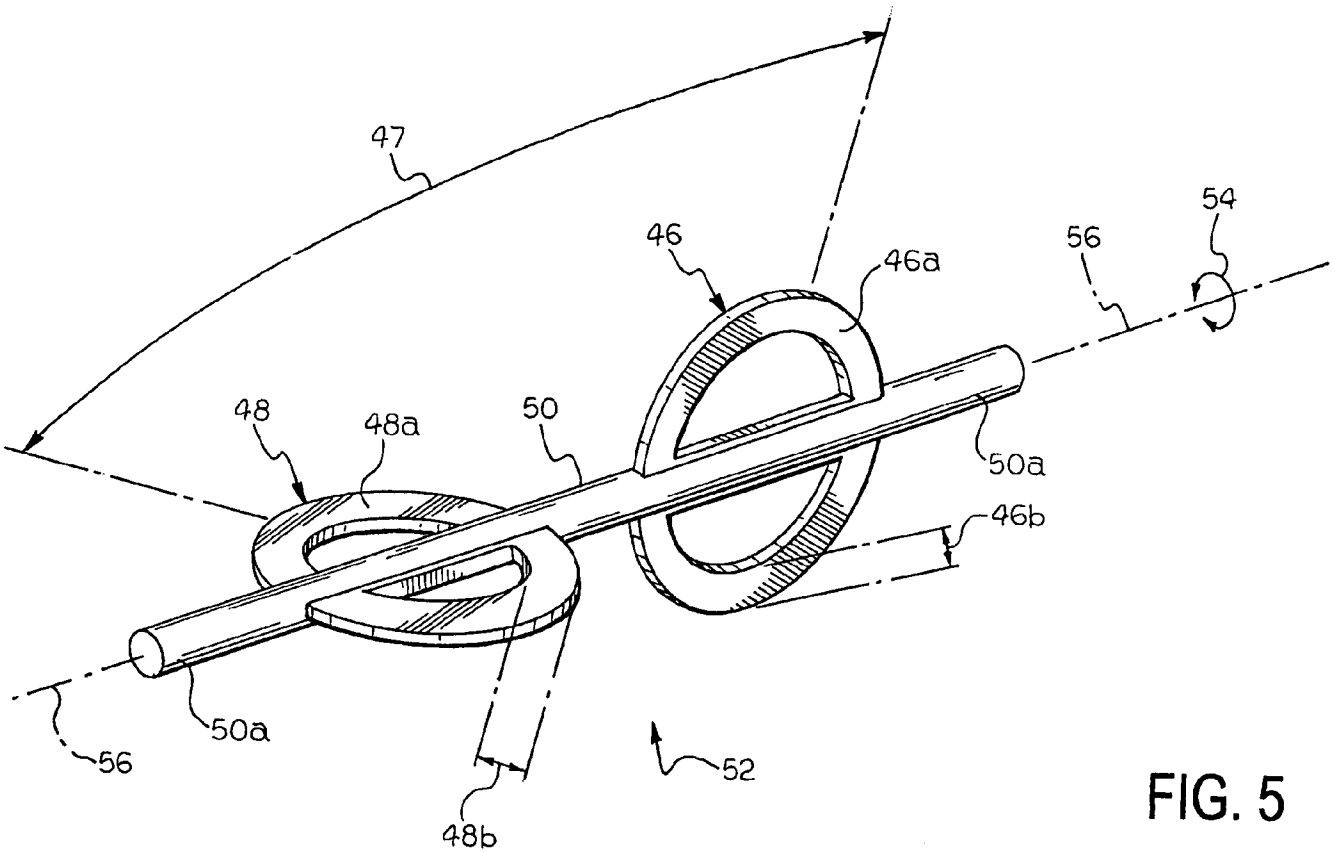
FIG. 4 is a perspective view of a shaft and valve subassembly in accordance with the present invention.

Referring now to FIGS. 2–4, the exhaust valve assembly 24 is shown in a greater detail. The valve assembly 24 includes a valve body 40 having a first opening 42 and a second opening 44 extending between the inlet portion 26 and the outlet portion 28 thereof. Exhaust gas flows through the valve body 40 from the inlet portion 26 to the outlet portion 28 in a gas flow direction indicated by an arrow 27. A first restrictor plate or valve 46 is disposed in the first opening 42 intermediate the inlet portion 26 and the outlet portion 28. A second restrictor plate or valve 48 is disposed in the second opening 44 intermediate the inlet portion 26 and the outlet portion 28.

Best seen in FIG. 4, the first valve 46 and the second valve 48 are attached to a valve shaft 50, forming a valve and shaft subassembly, indicated generally at 52. The shaft 50 is rotatable in a direction indicated by an arrow 54 about a longitudinal axis 56 thereof. The valves 46 and 48 are preferably butterfly-type valves which provide minimal restriction to flow when in an open position, discussed in more detail below. The valve 46 includes a peripheral portion 46*a* and the valve 48 includes a peripheral portion 48*a*. The peripheral portion 46*a* has a thickness indicated by an arrow 46*b* and the peripheral portion 48*a* has a thickness indicated by an arrow 48*b*. The thickness 46*b* of the first valve 46 is less than the thickness 48*b* of the second valve 48. Those skilled in the art will appreciate that the thickness 46*b* of the first valve 46 and the thickness 48*b* of the second valve 48 may be chosen to provide differing amounts of restrictions, depending on the requirements of the particular exhaust system 10, allowing the valve assembly 24 to provide multiple restrictions. The peripheral portions 46*a* and 48*a* each conform to substantially the same profile as respective interior surfaces of the openings 42 and 44 in the valve body 40 when the valve and shaft subassembly 52 is attached to the valve body 40. The valves 46 and 48 are attached to the shaft 50 in an offset orientation, wherein a longitudinal axis of each of the valves 46 and 48 is spaced apart by a predetermined angle, indicated by an arrow 47. Preferably, the angle 47 is such that the valves 46 and 48 are substantially perpendicular to each other on the shaft 50.

Referring again now to FIGS. 2 and 3, when the subassembly 52 is attached to the valve body 40 to form the exhaust valve assembly 24, the shaft 50 extends across the first opening 42 and the second opening 44 and is rotatable in the direction 54 about the longitudinal axis 56 of the shaft 50. Preferably, a pair of bushings 58 is disposed in a pair of opposed bosses 60 extending outwardly from the valve body 40 in a direction substantially perpendicular to the exhaust gas flow direction 27. Each of the bushings 58 receives an opposed end 50*a* of the shaft 50, best seen in FIG. 4, and reduce the friction and thereby the energy required to rotate the shaft 50 in the direction 54. Preferably, at least a portion of one of the ends 50*a* of the shaft 50 extends beyond the outer surface of the respective boss 60 for cooperation with an actuator, discussed in more detail below.

The valve assembly 24 in FIG. 2 is shown in a first position wherein the first valve 46 is in a closed position and the second valve 48 is in an open position. In the closed position, the peripheral portion 46*a* of the first valve 46 is oriented in a direction close to perpendicular to the flow direction 27 and the interior walls defined by the first opening 42 of the valve body 40 wherein the valve 46 restricts the flow of exhaust gas through the first opening 42 of the valve body. In the open position, the peripheral portion 48*a* of the second valve 48 is oriented in a direction substantially parallel to the flow direction 27. In the open position, the second valve 48 produces only a very minimal restriction to flow of exhaust gas through the second opening 44 of the valve body 40.

The valve assembly 24 in FIG. 3 is shown in a second position wherein the shaft 50 has been rotated through the angle 47 such that the first valve 46 is in an open position and the second valve 48 is in a closed position. In the open position, the peripheral portion 46*a* of the first valve 46 is oriented in a direction substantially parallel to the flow direction 27 wherein the valve 46 produces only a very minimal restriction to flow of exhaust gas through the first opening 42 of the valve body 40. In the closed position, the peripheral portion 48*a* of the second valve 48 is oriented in a direction close to perpendicular to the flow direction 27 and the interior walls defined by the second opening 44 of the valve body 40. In the closed position, the peripheral portion 48*a* of the second valve 48 restricts a predetermined amount of exhaust gas flow through the second opening 44 of the valve body 40. The predetermined amount of exhaust gas flow restricted by the closed second valve 48 depends on the thickness 48*b* of the peripheral portion 48*a* of the second valve 48. Similarly, the predetermined amount of exhaust gas flow restricted by the closed first valve 46 depends on the thickness 46*b* of the peripheral portion 46*a* of the second valve 46. Because the thickness 48*b* is greater than the thickness 46*b*, the exhaust valve assembly 24 restricts a great amount of exhaust gas flow in the second position shown in FIG. 3 than it does in the first position shown in FIG. 2.

Figure 5:
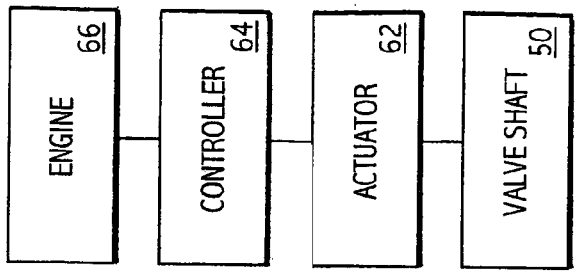
FIG. 5 is a schematic block diagram of a portion of the exhaust system of FIG. 1 including a controller in accordance with the present invention.

Referring now to FIG. 5, the shaft 50 of FIGS. 2–4 is shown schematically and attached to an actuator 62. The actuator 62 is preferably an electric motor, such as motors used for butterfly valves in throttle bodies or the like, a solenoid, or the like that is operable to attach (not shown) to an end 50*a* of the shaft 50 and rotate the shaft 50 in the direction 54. The actuator 62 is operable to selectively rotate the shaft 50 the angle 47 to move the valve assembly 24 between the first position shown in FIG. 2 and the second position shown in FIG. 3. The actuator 62 is connected to a controller 64, such as a vehicle powertrain controller or the like. The controller 64 is operable to send a command signal to the actuator 62 to rotate the shaft 50 between the first and second positions of FIGS. 2 and 3. The controller 64, in turn, is connected to an engine 66, preferably a variable displacement vehicle internal combustion engine having a pair of exhaust manifolds or catalytic converters (not shown) adapted to be connected to the respective ends 16 and 18 of the exhaust pipes 12 and 14 of FIG. 1. The controller 64 is operable to receive a status signal from the engine 66 that determines when the controller 64 sends the command signal to the actuator 62 to rotate the shaft 50 between the first and second positions of FIGS. 2 and 3.

In operation, the engine 66 is operated and monitored by the controller 64. If the engine 66 is in a first or high output mode, the engine 66 provides a status signal to the controller 64 indicating the first mode status. The controller 64 then provides a command signal to the actuator 62 to move the valve shaft 50 and therefore the valves 46 and 48 to the first, lower restriction position shown in FIG. 2. If the engine 66 is in a second or low output mode, the engine 66 provides a status signal to the controller 64 indicating the second mode status. The controller 64 then provides a command signal to the actuator 62 to move the valve shaft 50 and therefore the valves 46 and 48 to the second, higher restriction position shown in FIG. 2. As the modes of the engine 66 change during operation, the corresponding position of the valve assembly 24 advantageously changes to accommodate the changes in exhaust gas flow from the engine 66 while providing the required back pressure for the engine 66.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A valve assembly adapted to be disposed in an automotive engine exhaust system at an outlet of an internal combustion engine, comprising:

a valve body having an opening therethrough including an inlet portion and an outlet portion;

a first valve disposed in the opening intermediate said inlet portion and said outlet portion, said first valve having an open position and a closed position, and said first valve blocking a first predetermined amount of said opening when in the closed position;

a second valve disposed in the opening intermediate said inlet portion and said outlet portion, said second valve having an open position and a closed position, and said second valve blocking a second predetermined amount of said opening when in the closed position, with said second predetermined amount being less than said first predetermined amount; and an actuator connected to said first valve and said second valve and operable to selectively move each of said valves between respective said open positions and said closed positions.

2. The valve according to claim 1 wherein said valve body has a second opening therethrough including a second inlet portion and a second outlet portion.

3. The valve according to claim 2 wherein said first valve is disposed intermediate said first inlet and outlet and said second valve is disposed intermediate said second inlet and outlet.

4. The valve according to claim 1 wherein said first valve is in the open position when said second valve in the closed position.

5. The valve according to claim 1 wherein said first valve is in the closed position when said second valve in the open position.

6. The valve according to claim 1 wherein said first and second valves are each attached to a shaft and said actuator is attached to said shaft.

7. The valve according to claim 1 wherein said first valve is a restrictor plate valve having a first peripheral portion that has a first radial thickness and said second valve is a restrictor plate having a second peripheral portion that has a second radial thickness, said second radial thickness being less than said first radial thickness.

8. The valve according to claim 6 wherein each of said valves has a longitudinal axis arranged substantially perpendicular to one another along a longitudinal axis of said shaft.

9. The valve according to claim 1 including a controller in communication with said actuator, said controller operable to send a command signal to said actuator to move said valves between the respective first and second positions.

10. The valve according to claim 9 wherein said first and second positions of said valves corresponds to a change in engine status received by said controller.

11. An automotive internal combustion engine exhaust system adapted to receive exhaust gases from an internal combustion engine, comprising:

at least one exhaust duct leading from said engine;

a valve body having an opening therethrough including an inlet portion in fluid communication with said at least one exhaust duct and an outlet portion;

a first valve disposed in the opening intermediate said inlet portion and said outlet portion, said first valve having an open position and a closed position, said first valve blocking a first predetermined amount of said opening when in the closed position, and said first valve being a restrictor plate valve having a first peripheral portion that has a first radial thickness;

a second valve disposed in the opening intermediate said inlet portion and said outlet portion, said second valve having an open position and a closed position, said second valve blocking a second predetermined amount of said opening when in the closed position, with said second predetermined amount being less than said first predetermined amount, and said second valve being a restrictor plate having a second peripheral portion that has a second radial thickness, said second radial thickness being less than said first radial thickness;

an actuator connected to said first valve and said second valve and operable to selectively move each of said valves between respective said open positions and said closed positions;

a controller in communication with said actuator, said controller operable to send a command signal to said actuator to move said valves between said first position to said second position; and a shaft attached to said first valve, said second valve and said actuator.

12. The exhaust system according to claim 11 wherein said valve body has a first opening including a first inlet portion and a first outlet portion and a second opening therethrough including a second inlet portion and a second outlet portion and wherein said first valve is disposed intermediate said first inlet and said first outlet and said second valve is disposed intermediate said second inlet and said second outlet.

13. The exhaust system according to claim 12 further comprising a muffler, and wherein said first outlet portion and said second outlet portion are connected to a muffler.

14. The exhaust system according to claim 11 wherein said first and second positions of said valves corresponds to a change in engine status received by said controller.

15. An automotive internal combustion engine exhaust system, comprising:

a variable displacement engine;

at least a pair of exhaust ducts extending from said engine;

a valve assembly attached to said pair of exhaust ducts, said valve assembly including;

a valve body having a first inlet portion and a second inlet portion each connected to a one of said pair of exhaust ducts and a first outlet portion and a second outlet portion;

a first valve disposed in said valve body intermediate said first inlet portion and said first outlet portion;

a second valve disposed in said valve body intermediate said second inlet portion and said second outlet portion;

an actuator connected to said first valve and said second valve and operable to selectively move each of said valves between a first position and a second position; and a controller in communication with said actuator and said engine, said controller operable to receive a status signal from said engine and send a command signal based on said status signal to said actuator to move said valves between said first position and said second position.

16. The exhaust system according to claim 15 wherein said first and second valves are attached to a shaft and said actuator is attached to a free end of said shaft.

17. The exhaust system according to claim 16 wherein said first valve in said first position blocks a first predetermined amount of said first outlet portion and said second valve in said second position blocks a second predetermined amount of said second outlet portion, with said second predetermined amount being less than said first predetermined amount.

18. The exhaust system according to claim 15 further comprising a muffler, arid wherein said first and second outlets of said valve body are both connected to said muffler.

* * * * *